US007442174B2

(12) United States Patent
Butler

(10) Patent No.: US 7,442,174 B2
(45) Date of Patent: Oct. 28, 2008

(54) SIMULATED WAVE MASSAGE

(76) Inventor: Charles F. Butler, 2130 South Park, Kalamazoo, MI (US) 49001

( * ) Notice: Subject to any disclaimer, the term of this patent is extended or adjusted under 35 U.S.C. 154(b) by 181 days.

(21) Appl. No.: 10/902,196

(22) Filed: Jul. 29, 2004

(65) Prior Publication Data

US 2007/0135740 A1 Jun. 14, 2007

Related U.S. Application Data

(63) Continuation of application No. 10/039,303, filed on Jan. 2, 2002.

(60) Provisional application No. 60/260,025, filed on Jan. 5, 2001, now abandoned.

(51) Int. Cl.
*A61H 1/00* (2006.01)

(52) U.S. Cl. ..... 601/47; 601/15; 601/28

(58) Field of Classification Search ..... 601/15, 601/18, 46, 47, 49, 56, 57; 600/26–28, 300
See application file for complete search history.

(56) References Cited

U.S. PATENT DOCUMENTS

| | | | | | |
|---|---|---|---|---|---|
| 4,753,225 | A * | 6/1988 | Vogel | 601/47 |
| 4,967,871 | A * | 11/1990 | Komatsubara | 181/141 |
| 5,035,235 | A * | 7/1991 | Chesky | 601/47 |
| 5,101,810 | A * | 4/1992 | Skille et al. | 601/47 |
| 5,113,852 | A * | 5/1992 | Murtonen | 601/47 |
| 5,269,304 | A * | 12/1993 | Matthews | 607/46 |
| 5,473,700 | A * | 12/1995 | Fenner, Jr. | 381/336 |
| 6,461,316 | B1 * | 10/2002 | Lee et al. | 601/46 |

* cited by examiner

*Primary Examiner*—Glenn Richman
(74) *Attorney, Agent, or Firm*—Barnes & Thornburg LLP

(57) ABSTRACT

Method, procedure, and device for applying tactile sensation and vibration to the human body. In this invention one (or more vibrating) elements emit sine waves between 20 and 800 Hz. These waves are varied in frequency, amplitude and rhythm to create in the subject the sensation of massage moving through different parts of the body even though the signal emitter may be a point source.

10 Claims, 3 Drawing Sheets

SIMULATED WAVE MASSAGE

CROSS-REFERENCE TO RELATED APPLICATION

This is a continuation of application Ser. No. 10/039,303, filed Jan. 2, 2002, which is a continuation of provisional application Ser. No. 60/260,025, filed Jan. 5, 2001.

FIELD OF THE INVENTION

This invention relates to a method, procedure and device for applying tactile sensation and vibration to the body, and will have specific but not limited application to the human body.

BACKGROUND

Vibration has been applied to the human body from time immemorial. Many patents exist for mechanical vibrating devices. The quintessential prototypes of these are devices of the asymmetric flywheel variety. Ordinary mechanical vibrating devices are used to relieve pain and induce relaxation. It is established that the effect of vibration is increased as the surface area of the human body exposed to vibration becomes greater. Unfortunately, mechanical vibrating devices when applied to a large surface area of the human body may cause motion sickness and other deleterious side effects because of infrasonic (less than 20 Hz) resonances inherent in their non-linear design. In addition, all mechanical vibrating devices when applied to a specific point on the body for an extended period of time create numbness. The salutary effects sought after quickly fade because of "stimulus fatigue", a phenomenon whereby repetitive stimulation of nerve endings ceases to be transmitted because the nerve fatigues. To overcome the cessation of nerve transmission using a mechanical vibrator requires exponentially increasing stimulus strength which is possible for only a limited time. Therefore, the sought after beneficial effect ceases due to the stimulus fatigue phenomenon.

Inventors and researchers have discovered that vibration created by music could be applied to the human body through devices such as simple speakers. This application of inserting speakers for the playing of music into sofas, chairs and pads can result in relaxation and pleasing sensation. U.S. Pat. No. 5,143,055, for example, discloses such a simple device. Any positive effect of such a device will be random depending upon the chosen music.

U.S. Pat. No. 5,101,810 teaches that specific sound frequencies in the range of 30 to 120 Hz can be embedded in music and transmitted to the human body through loud speakers to massage a specific portion of the human body or to treat specific bodily complaints. The specific sine wave frequency (for example, 39 Hz) would become tedious and boring if it was not embedded in music. For this reason the method of this patent is always used in conjunction with music. Separate ambient speakers and amplifiers are used for the accompanying music. U.S. Pat. No. 5,101,810 specifies the use of two or more loud speakers playing through two channels. One channel is used for auditory stimulation with this chosen music. The second channel generally plays through a speaker(s) affixed to a bed or chair upon which the subject lies. The frequency chosen for application to the subject is embedded in the music played through that affixed speaker(s). Earlier tapes generally contained only one embedded frequency. Later tapes sometimes contained several frequencies embedded in different parts of the music to relieve monotony or to stimulate another muscle or nerve. The low frequency sine wave signal is further made more palatable by administering it in pulsatile form. The pulse is created and its duration determined by phase cancellation mixing the desired frequency with another frequency very close to it. For example, mixing a 60-hertz frequency with a 60.07 Hz frequency would generate a pulsatile signal of approximately 14 seconds duration. According to the "resonance theory", the teaching of U.S. Pat. No. 5,101,810 faces limitations in scanning ability inherent in the use of the "phase cancellation". In practice it is limited to the effect generated by the specific frequency implanted in the music. The system is expensive to implement. It requires a therapist/technician to operate a sine wave generator. The technician must have sufficient training to determine appropriate frequencies and implant them in the music for each patient.

The frequencies recommended in of U.S. Pat. No. 5,101,810 are anatomic in nature. Different frequencies are chosen according to the specific muscle or the disease process to be treated. The specific frequency within the ranges broadly specified below is determined by using a sine wave generator to test each subject on a sound bed. This frequency is implanted into music. Below is Skille's (one of the inventors of U.S. Pat. No. 5,101,810) recommendation of ranges from which to choose a specific frequency for a cited problem.

| Condition | Frequency |
|---|---|
| 1. Spastic Conditions | 1. 40-60 Hz |
| 2. Premenstrual Tension | 2. ~50 Hz |
| 3. Back Pain | 3. ~50 Hz |
| 4. Asthmatic Conditions | 4. 40-70 Hz |
| 5. Sports | 5. 40-60 Hz |
| 6. Muscle Cramps and Pain | 6. 40-90 Hz |
| 7. Different Stress Problems | 7. 40-70 Hz |
| 8. Insomnia | 8. 40-70 Hz |
| 9. Rheumatic Conditions | 9. 40-90 Hz |
| 10. Frozen hand and feet | 10. 40-60 Hz |
| 11. Headache | 11. 60-90 Hz |
| 12. Multiple Sclerosis | 12. 40-60 Hz |

This method is criticized in U.S. Pat. No. 5,113,852 as not addressing the problem of "stimulus fatigue".

To address this problem U.S. Pat. No. 5,113,852 provides a procedure for applying vibration acoustically to the human body by means of vibrating elements to produce a pleasant feeling for the relaxation of the body, each of such vibrating elements being vibrated at a single audio frequency in the range of 20 Hz to 200 Hz with the vibrating elements arranged in a substantially linear array, so that each of the vibrating elements may be adjacent to a specific region of the human body. U.S. Pat. No. 5,113,852 then specifies cyclically and continuously varying the intensity of vibration of each of the vibrating elements periodically between maximum and minimum values other than zero to generate an intensity maxima at a predetermined frequency of occurrence and further driving each of the vibrating elements at different times by providing a phase difference between the intensity maxima generated by the adjacent of the vibrating elements, so that the intensity maxima may occur successively in adjacent ones of the vibrating elements along the linear array to produce the sensation of the wave traveling along the human body. The method of this patent is effective. It addresses the problem of "stimulus fatigue" by moving an audio frequency to each of this series of linearly arranged vibrating elements with a predetermined time delay which provides actual motion of the signal and temporal relief for the various parts of the human body being intermittently vibrated.

It is recognized that specific parts of the body respond to specific frequencies. For example the great muscles of the back are generally stimulated by frequencies in the 50-hertz range. It is also known that to achieve the same locus of sensation in a different subject or in the same subject at a different time, the frequency may have to be changed by several Hz. If one were to accept the "resonance theory", this could be the result of natural changes in hydration state changing the thickness of the tubular structure (muscle or nerve) to be vibrated. In my experimental practice of the method of U.S Pat. No. 5,113,852, very small frequency variations in the phase program passing through each element have been used to allow a single tape or program to be used to stimulate the same body part for multiple patients. This is to accommodate small individual differences in resonance frequencies. If one wishes to stimulate relaxation of the central nervous system, it is known that the brain generates oscillating waves at 40 Hz. There is a small variation between individuals. Using the "resonance theory" one would wish to set up a resonance between the vibratory elements and the subject's brain. The sine wave stimulation program passing through each vibratory element may scan between 39 and 41 Hz. The effect of this scanning is the ability to achieve a resonance frequency in a higher proportion of treated subjects.

The afore-described patents disclose the physiologic use of only a narrow frequency range. This is because sounds above 120 Hz are better heard than felt. Using conventional speakers to produce sufficient air pressure to generate tactile sensations from frequencies as high as 800 Hz would create auditory damage. Baseshakers previously described in U.S. Pat. No. 4,326,506 are very limited in range, generally well under 100 Hz. Beyond a very narrow frequency band they are generally deficient in quality waveform reproduction when observed on an oscilloscope. For example, the Aura TM Baseshaker (U.S. Pat. No. 4,326,506) has a very narrow band, centered around 40 Hz, within which it can reproduce low frequency waves accurately. Even marginally acceptable reproduction tops out at about 100 Hz.

In practice almost all programs following the teachings of U.S. Pat. Nos. 5,101,810 and 5,113,852 have been written for frequencies below 70 Hz. Conventional speakers are very limited in their ability to produce significantly tactile sound in frequencies higher than 120 Hz. With conventional speakers pleasureability for most people disappears above 70 Hz.

Until the subject invention, no one had solved the problem of "stimulus fatigue" to attain long-term beneficial effects through the vibration of the human body using a method that required only a simple inexpensive point source vibratory element. It would obviously be desirable to develop a simple, cost-efficient method to address the problems of "stimulus fatigue" and to attain long-lasting benefits of therapeutic vibrational massage. It would also be desirable to broaden the frequency ranges possible for therapeutic tactile sound or sine wave massage.

SUMMARY OF INVENTION

This invention utilizes substantially continuous frequency variation, frequency and amplitude variation, or frequency, amplitude and rhythm variation through a tactile sound transducer (TST) to create a wave like or "moving" vibrational massage effect.

In this invention the frequency range of 20 to 800 Hz is used. It calls upon specific frequencies to treat specific areas of the body or specific physiologic problems (for example, muscle ache). But, uniquely, it utilizes broad changes in frequency (or) frequency and amplitude (or) frequency and amplitude and rhythm to move the signal emanating from a single transducer (though multiple transducers could also be used) to stimulate different areas of the body and physiologic systems. The passage through proximate frequencies implicit in continuous broad range scanning allows the programs to be effective for a broad range of individuals. Broad range scanning of frequency (with or without amplitude variation, rhythm variation and pauses) is used to allow some areas to rest and recover while others are being stimulated. This allows a solution for the "stimulus fatigue" problem by a one-transducer system. This allows sine wave stimulation that creates long-lasting effects (no "stimulus fatigue") to be produced more simply and at much lower cost by the elimination of multiple transducers and amplifiers. A simple example of such a program might be one that starts in the vicinity of 40 Hz scanning at variable rates up to 58 Hz thus creating a pleasant massage effect on the thighs as well as lower and upper back. Though such a program can be written so as to be pleasurable without music, music may be added to enhance its enjoyment.

Accordingly, it is an object of this invention to provide a system to apply tactile sensation and vibration to the human or animal body.

DESCRIPTION OF THE PREFERRED EMBODIMENTS

Figure 1:
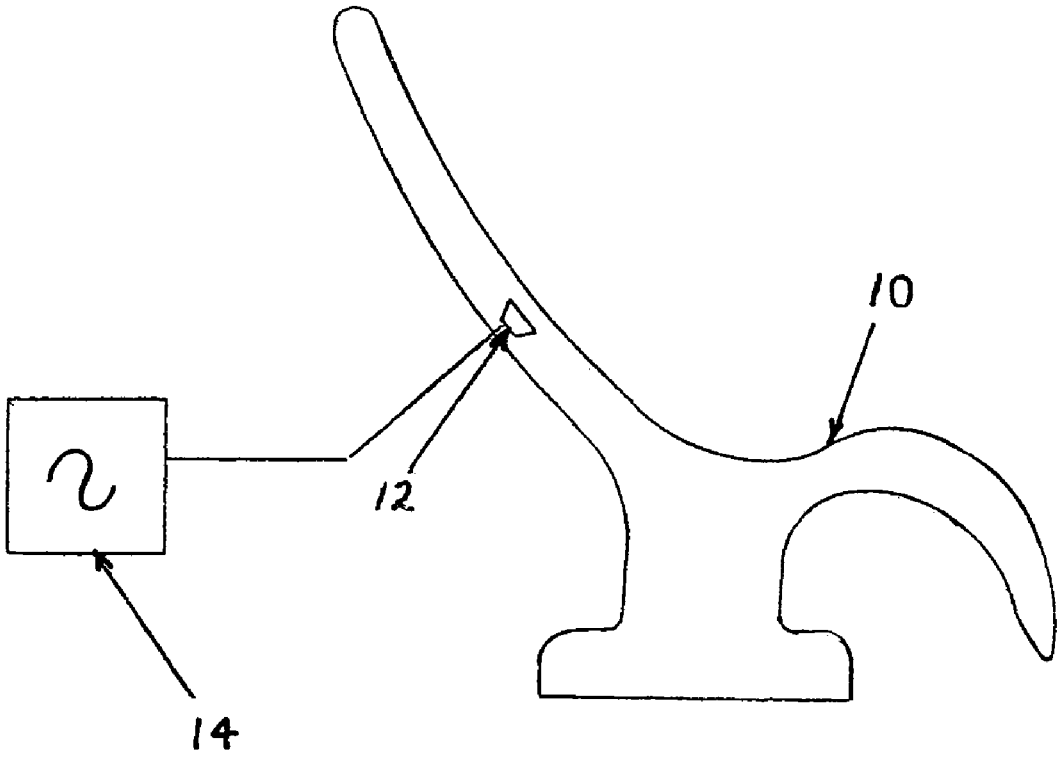
FIG. 1 shows one embodiment of this invention using a single transducer.

Different frequencies have been used to treat specific parts of the body because they are perceived in those specific parts of the body. In this invention frequency changes are used to move stimulation from body part to body part. This use of frequency variation, not to treat a specific muscle or disease, but rather to create motion of the stimulus itself provides a solution to the problem of "stimulus fatigue". It allows the moving massage to go from body part to body part, while unstimulated body parts recover. For example, a subject sits in a chair to which is attached to a TST 12 (see FIG. 1). A simple program is used to activate a common wave generator 14 which produces a program of constantly or almost constantly changing (to allow for revisal of the increasing or decreasing frequency values) frequencies from 48 to 58 Hz to massage the subject's entire back. The stimulus would move according to the rate of frequency change.

Amplitude variation can also be used to move the perception of an energy wave stimulus. Amplitude variation ranges can be chosen anywhere from 0 to 120 decibels. The addition of amplitude variation to frequency variation not only helps with the signal to defeat the problem of "stimulus fatigue", it also makes the sensation much more pleasurable and enjoyable without the necessity of mixing with music. For example, a subject lies on the bed suitably activated by a TST. A simple program of almost constantly changing amplitude within a chosen range with limits of 0 to 120 decibels and frequency between 40 and 60 hertz will provide the subject with a total body massage. The subject will perceive massage as moving from body part to body part with the changes of amplitude and frequency.

Rhythm variation may be added to variation of amplitude and frequency to achieve various physiologic effects. Amplitude and frequency variation administered with a strong rhythmic pattern may be used to excite as well as massage the subject. An arrhythmic presentation using the same amplitude and frequency variations may be used to relax the subject. For example, a subject again sits on a TST activated recliner. This time he experiences a sine wave program changing amplitude (anywhere within the range of 0 to 120 decibels) and frequency (within the range of 48 to 56 Hz). A strong rhythmic beat is added to create a pounding arousing sensation to the areas of the back being massaged. The infinite possible variations of rhythm can be used to create a wide variety of pleasurable, stimulating, relaxing sensations.

Varying the amplitude/frequency/rhythm (although one could insert pauses for special effects) solves the problem of "stimulus fatigue" by physically changing the locus that is stimulated—for example muscle groups, central nervous system. Unstimulated areas are permitted to recover while other recovered areas are being stimulated. This allows maximal and undiminishing benefit.

A broader range of tactile sound available for therapeutic purposes will offer the therapist a wider range of therapeutic options. Thus a second aspect of the current invention involves the therapeutic use of tactile sound through the widened range of 20 to 800 Hz. This broad range of tactile frequencies for therapeutic purposes is made possible by using devices such as the Clark Synthesis Transducer (U.S. Pat. No. 5,473,700) (Model 229) or any new transducer with similar or greater capabilities. These devices are defined as TST's for the purpose of this invention. These devices generate sound combined with more acceleration energy than ordinary speakers. They create a more "tactile" experience. They are suitable for the full range of music appreciation as well as for the present invention. Unlike speakers, and baseshakers, they allow the tactile appreciation of sound up to 800 Hz without generating either dangerous or uncomfortable air pressures. As an example, the availability of these higher frequencies allows the creation of wave motion programs to perform "moving massage" of even the fine muscles of the hands, fingers and toes.

While this invention does not require the use of music, the addition of music to enhance pleasureability can be used. The addition of music would add all the benefits that is derived from music. Clark Synthesis Transducers are capable of reproducing music mixed with therapeutic wave motion programs. Music could likewise be added through the use of conventional speakers or earphones.

In some settings, for example in a multi-bed hospital ward, the use of this invention without music clearly avoids annoying the other patients in the room. Similarly, if this invention is used in devices such as a king-size bed, it might be better done without music out of respect to a sleep partner.

A single vibratory element is sufficient for the current invention, thus making an economical unit. Nevertheless, the current invention is not limited to the use of a single vibratory transmitter. Changing frequency, amplitude and rhythm within the claimed range of frequencies using multiple vibratory elements can create various interesting and pleasurable effects. This configuration will also provide a solution for the problem of "stimulus fatigue". One would envision commonly using either a single transmitter or two transmitters as would be available in the standard stereo system for the program's power source or wave generator.

Figure 2:
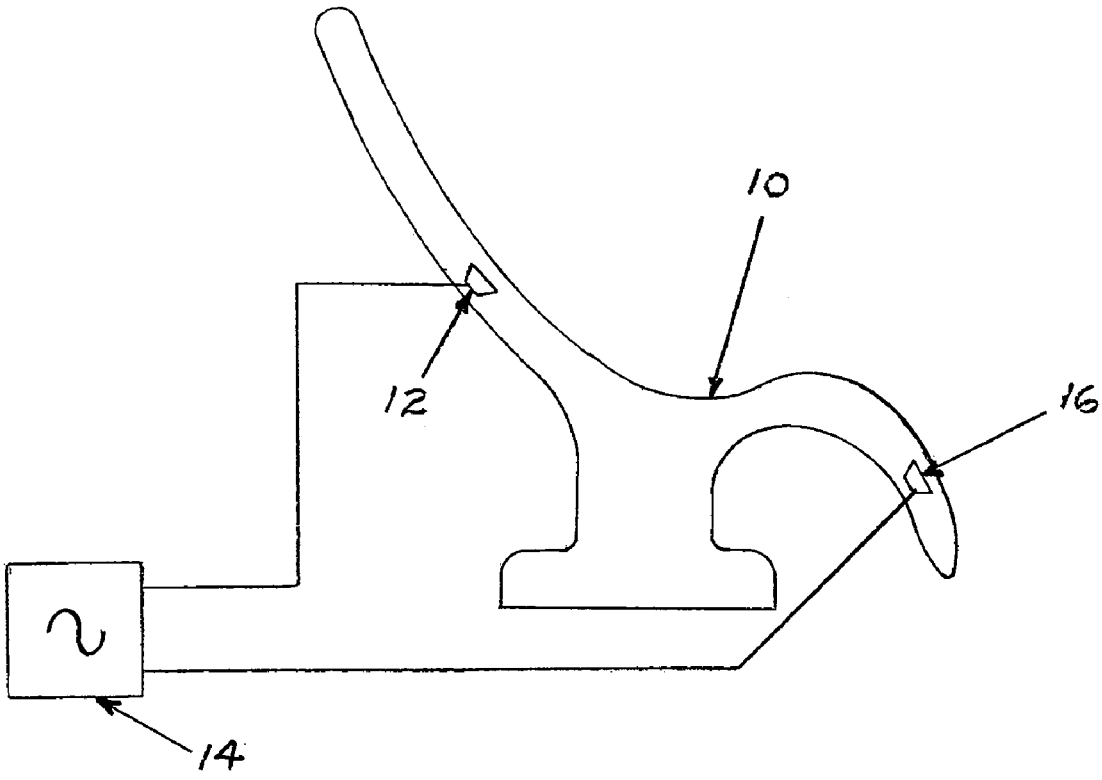
FIG. 2 shows another embodiment of the invention using two transducers.
Figure 3:
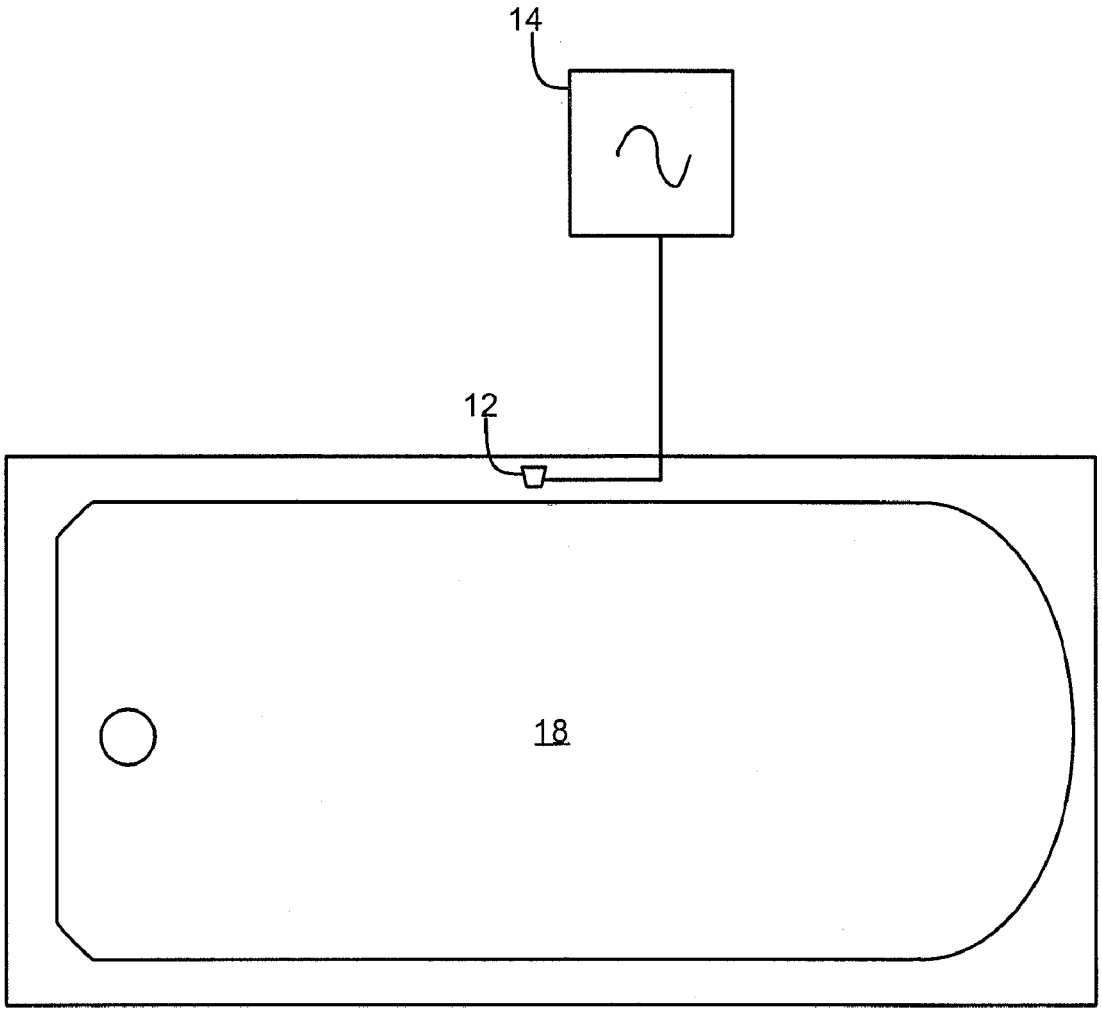
FIG. 3 shows another embodiment of the embodiment.

Another embodiment of this invention if used with multiple TST's would be performing tactile wave massage simultaneously over large but separate body surfaces. The essence of this unique application would be achieved by creating a program that would move throughout one area of the body by using frequency and/or amplitude and/or rhythm variations known to be active in that part. One would create a second or third program depending on the number of TST's in a similar fashion that would be active in massaging other areas of the body. These programs could then be run simultaneously utilizing two or more TST's in proximity to the targeted body areas. For example, a subject seated in a recliner with two TST's 12, 16 (see FIG. 2), one behind the back and one under the legs could experience simultaneous (or sequential) massage up and down the back, and up and down the legs. This would be accomplished with a program of varied frequency, amplitude and rhythm in the 50 Hz range for the back and one in the 40 Hz range for the legs. Although the addition of more than one TST would add slightly to the cost of utilizing this method, two channel stereo setups for the program's power source are common and the cost of one additional TST would be minimal. The variations of therapeutic programs, which it would permit, might make it desirable to many stereo users.

Frequency and amplitude modulation in various rhythms could be used through baseshakers or conventional speakers. This would solve the "stimulus fatigue" problem. While this use would adapt this invention to the limited frequency ranges used currently in tactile therapeutic use, the preferred form of this invention would incorporate the use of TST's for the frequency spectrum above 200 Hz. While it is envisioned that the amplitude/frequency combination of the therapeutic wave will be almost continuously varying, it is not beyond the scope of this invention to allow for pauses up to five seconds to achieve special effects. Similarly, is not beyond the scope of this invention to remain at a fixed amplitude/frequency for short periods to achieve special effects. The programs will vary stimulus sufficiently to avoid boredom and "stimulus fatigue".

The preferred form of the wave used for stimulation in this invention is a sine wave. Sine waves do not have resonances. The avoidance of infrasonic resonances of nonlinear systems virtually eliminates the harmful side effects of vibration. These harmful effects include:

0.5 to 1.5 Hz—motion sickness;

2 Hz—nystagmus;

4 Hz—decreased hand-eye coordination; etc.

This though does not prevent the invention from using square waves or saw tooth waves on occasion to achieve special effects.

Programs incorporating appropriate sine waves preserved on tapes, CDs, chips or other media and played through a conventional stereo amplifier set up using a TST may achieve the current invention. The current program may be fed through a mixer so as to combine it with music. It may then be played through the Clark Synthesis Transducer, speaker or other wave source. As an example for creating a program, a function generator (such as Metex MXG-9802) is connected through a computer's sound card (such as Sound Blaster TM) to the computer's analog recording device. The signal is then transferred from the analog recording device to a program such as "Sound Forge" or "Cool Edit" where it is converted to digital format. The program itself is created by setting the function generator to "sine wave". One of the generator's order of frequency buttons (usually X10 or X100) is selected to facilitate the creation of the program in the desired frequency range. Turning the volume knob controls the signal amplitude. Turning the frequency selection knob controls the signal frequency. The rhythm is imposed on the program by the rate of change of turning the amplitude and frequency knobs. Pauses (0 amplitude) are reached by adding a variable resistor in line between the sine generator and the computer input. The variable resistor is chosen to generate a very high resistance (10 to 50,000 Ohms) rate compared to the low-power generator signal. Turning the resistor from zero resistance to a high resistance effectively brings the amplitude to 0 and creates a pause in the program.

Once the program is recorded in analog form on the recording device and converted to digital form in the "Sound Forge" or "Cool Edit" programs, it may be copied onto a CD. The program is then played through an amplifier into the transducers thence into the chair or bed for testing. If the program is pleasing and appears to achieve the desired goals, it may be further edited by selecting and repeating the most attractive parts of it. Its length can be manipulated by recycling or cutting sections as desired (using "Sound Forge" or "Cool Edit") and the program then copied to IC, CD, tape or other means for use.

The copied program is then transmitted through an amplifier either directly to the transducers in the chair (bed, training table, etc.) where it may be used by a client; or, the program may be transmitted from amplifier to a mixer for the addition of music from another source and thence to the transducer and chair, bed, or training table.

The current invention may be incorporated in a mattress, a pad, a bed, a chair, or a table (such as a training table). It may be used to activate a floor or may be incorporated in a garment to treat humans or even animals (for example, in horse saddlebags). The current invention could also be used in a device such as a home entertainment chair allowing the subject to receive the benefits provided by simulated wave massage while enjoying a movie or watching television (with or without a mix of tactile sound).

The TST's used in this invention may be incorporated in various support structures such as by the creation of pockets, embedded in material covering such as foam, or by being affixed solidly to a rigid structural frame. Equally, the current invention is suitable for use through liquid media, such as swimming pools, Jacuzzis, etc. This type of system may be created using transducers such as the Clark Synthesis Transducers affixed to a liquid filled tank 18, hot tub, spa or shower or under water transducers and generating sine wave programs through them.

The support structure for this invention could be constructed in such a way as to contain the entire invention that might then be activated by a radio frequency device, other hand control, or control panel. Alternatively such support structure could be constructed in such a way that the TST's might be affixed to it or in it, with the rest of the invention such as the wave generator external.

To receive the benefit of the current invention, the subject should sit in a suitable proximity to the vibratory element. The TST may create its effect by direct contact or indirectly through the bedding, chair, table, other surface, or aqueous environment through which the vibratory stimulus passes. The ideal embodiment of this invention (FIGS. 1 and 2) would be a comfortable reclining lounge chair to which one or two TST's would be affixed. The lounge chair should be constructed in such a way that it could be completely activated by the TST's used. The subject would recline in the lounge chair. A "whole body" wave motion massage program might be mixed with music chosen by the subject and fed through a conventional amplifier to the TST's. The frequency/amplified/rhythm of the wave motion massage program would be selected to be compatible with the music. Both the music and wave massage program should be compatible for any desired physiologic effect. The quality of the music might be enhanced by the addition of earphones or perhaps additional high quality mid to high range speaker(s). One embodiment of this invention can utilize two TST's located adjacent different body parts in a two track stereo system. Two frequency-scanning programs of several seconds duration can be played at one-second delays with a pause of one second after playing the second track. This configuration creates the illusion of a linearly rolling massage.

The invention is not to be limited to the details above given but may be modified within the following claims.

I claim:

1. A method of providing vibrations to a human body, the method comprising the steps of:

A. Providing a single vibratory element adapted to provide a vibrational effect; wherein the vibratory element is a tactile sound transducer;

B. Positioning the vibratory element sufficiently near the human body to feel the vibrational effect, wherein the vibratory element has a substantially fixed position with respect to the human body;

C. Providing a wave generation device adapted to drive the vibratory element with a signal;

D. Providing a program for controlling the signal of the wave generation device, wherein the program is configured to stimulate a first body portion having a first resonance frequency and a second body portion having a second resonance frequency, wherein the program is configured to substantially continuously change a frequency of said signal to sweep a frequency range between the first resonance frequency and the second resonance frequency; and E. Playing the program to sweep the frequency range between the first resonance frequency and the second resonance frequency;

wherein the first body portion, but not the second body portion, is stimulated when the signal has a frequency approximately equal to the first resonance frequency; and wherein the second body portion, but not the first body portion, is stimulated when the signal has a frequency approximately equal to the second resonance frequency.

2. The method of claim 1, wherein the program is recorded in analog form using the wave generation device and then converted to digital form.

3. The method of claim 1, wherein the signal is a sine wave having a frequency above 200 Hz.

4. The method of claim 1, wherein the program is configured to substantially continuously change an amplitude of said signal between 0 and 120 decibels.

5. The method of claim 4, wherein the program is configured to vary a rhythm of the signal.

6. The method of claim 1, wherein the program is configured to incrementally sweep a frequency of the signal from the first resonance frequency to the second resonance frequency.

7. The method of claim 1, wherein the signal is represented by the following function:

$$u(t)=a\sin[\omega(t)\,t],$$

where u(t) is the signal, a is the an amplitude of the signal, and ω(t) is a frequency of the signal that changes as a function of time.

8. The method of claim 1, wherein the frequency of the signal has a single frequency component at any given time.

9. A method of providing vibrations to a human body, the method comprising the steps of:

A. Providing a first vibratory element adapted to provide a vibrational effect;

B. Providing a second vibratory element adapted to provide a vibrational effect;

C. Positioning the first vibratory element and the second vibratory element sufficiently near the human body to feel the vibrational effects, wherein the first vibratory element and the second vibratory element have a substantially fixed position with respect to the human body;

D. Providing at least one wave generation device adapted to drive the first vibratory element with a first signal and the second vibratory element with a second signal;

E. Targeting the stimulation of a first body portion having a first resonance frequency and a second body portion having a second resonance frequency;

F. Continuously changing a frequency of the first signal to sweep a frequency range surrounding the first resonance frequency;

G. Continuously changing a frequency of the second signal to sweep a frequency range surrounding the second resonance frequency;

H. Actuating the wave generation device to cause the first vibratory element to stimulate the first body portion when a frequency of the first signal is approximately at the first resonance frequency;

I. Actuating the wave generation device to cause the second vibratory element to stimulate the second body portion when a frequency of the second signal is approximately at the second resonance frequency; and wherein steps H and I occur simultaneously so that the first body portion and the second body portion are stimulated at substantially the same time when the first signal is at the first resonance frequency at the same time as when the second signal is at the second resonance frequency.

10. The method of claim 9, wherein the first signal and said second signal each have a single frequency component at any given time.

* * * * *